US010928023B2

(12) United States Patent
Rashidi Doust

(10) Patent No.: US 10,928,023 B2
(45) Date of Patent: Feb. 23, 2021

(54) HIGH BAY LIGHT FIXTURE

(71) Applicant: ELITE LIGHTING, Commerce, CA (US)

(72) Inventor: Hamid Rashidi Doust, Beverly Hills, CA (US)

( * ) Notice: Subject to any disclaimer, the term of this patent is extended or adjusted under 35 U.S.C. 154(b) by 780 days.

(21) Appl. No.: 15/179,183

(22) Filed: Jun. 10, 2016

(65) Prior Publication Data

US 2017/0356606 A1 Dec. 14, 2017

(51) Int. Cl.

| | |
|---|---|
| ***F21S 8/06*** | (2006.01) |
| ***F21V 29/508*** | (2015.01) |
| ***F21V 29/83*** | (2015.01) |
| ***F21V 23/00*** | (2015.01) |
| ***F21V 17/10*** | (2006.01) |
| ***F21V 19/00*** | (2006.01) |
| ***F21V 3/02*** | (2006.01) |
| ***F21V 23/04*** | (2006.01) |
| ***F21V 23/02*** | (2006.01) |

(52) U.S. Cl.

CPC *F21S 8/06* (2013.01); *F21V 3/02* (2013.01); *F21V 17/104* (2013.01); *F21V 19/0055* (2013.01); *F21V 23/002* (2013.01); *F21V 23/026* (2013.01); *F21V 23/0471* (2013.01); *F21V 29/508* (2015.01); *F21V 29/83* (2015.01)

(58) Field of Classification Search

CPC ..... F21S 8/06; F21V 29/83; F21V 29/508; F21V 23/002; F21V 3/02; F21V 19/0055; F21V 17/104; F21V 23/026; F21Y 2103/003

See application file for complete search history.

(56) References Cited

U.S. PATENT DOCUMENTS

| | | | | |
|---|---|---|---|---|
| 662,256 | A | 11/1900 | Dawson | |
| 664,706 | A | 12/1900 | Anderson | |
| 3,560,729 | A | 2/1971 | Liberman | |
| 6,758,580 | B1 | 7/2004 | Verfuerth | |
| 7,244,058 | B2 | 7/2007 | DiPenti et al. | |
| 7,261,436 | B2 * | 8/2007 | Haugaard | F21S 8/06 362/222 |
| 7,329,022 | B2 | 2/2008 | Tran et al. | |

(Continued)

OTHER PUBLICATIONS

Lithonia High Bay, Nov. 17, 2013.

*Primary Examiner* — Sharon E Payne
(74) *Attorney, Agent, or Firm* — Payam Moradian

(57) ABSTRACT

Provided is a light fixture comprising: a) a body, the body having a central portion and two side portions, each of the two side portions situated on one side of the central portion, the two side portions and the central portions running parallel to each other, the central portion recessed in an upward direction in relation to the two side portions, the recess of the central portion forming a ballast room inside of the body; b) two end caps, each end cap attached to an end of the body; c) a plurality of LED (light emitting diode) boards attached to an inside of the side portions of the body; d) one or more ballasts inside of the ballast room; e) a ballast room cover for covering the ballast room; and f) two rectangular-shaped lenses, each lens covering the LED boards attached to the side portion of the body. Each lens can contact the body on one of its long sides and contact the ballast room cover on its other long side.

16 Claims, 7 Drawing Sheets

(56) References Cited

U.S. PATENT DOCUMENTS

| | | | | |
|---|---|---|---|---|
| 7,926,985 | B2 | 4/2011 | Teng et al. | |
| 7,963,672 | B2 | 6/2011 | Liu et al. | |
| 8,136,958 | B2 | 3/2012 | Verfuerth et al. | |
| 8,337,043 | B2 | 12/2012 | Verfuerth et al. | |
| 8,376,583 | B2 | 2/2013 | Wang et al. | |
| 8,529,085 | B2 | 9/2013 | Josefowicz et al. | |
| 9,016,892 | B1 * | 4/2015 | Scribante | F21V 29/763 362/222 |
| 9,039,253 | B2 * | 5/2015 | Jin | F21S 8/04 362/154 |
| 2005/0015750 | A1 | 1/2005 | Sley | |
| 2005/0026501 | A1 | 2/2005 | Zhan | |
| 2005/0219846 | A1 * | 10/2005 | Floyd | F21V 23/026 362/264 |
| 2008/0025959 | A1 | 1/2008 | Daneman et al. | |
| 2012/0002411 | A1 | 1/2012 | Ladewig | |
| 2013/0008352 | A1 | 1/2013 | Roddy | |
| 2013/0155670 | A1 | 6/2013 | Handsaker | |
| 2015/0276155 | A1 | 10/2015 | Rashidi Doust | |
| 2016/0208998 | A1 * | 7/2016 | Greinke | F21S 8/061 |

* cited by examiner

HIGH BAY LIGHT FIXTURE

BACKGROUND SECTION OF THE INVENTION

Light Emitting Diodes ("LED") have become increasingly popular due to their low electricity usage. Light Emitting Diodes have begun replacing fluorescent lights in light fixtures. There is a need in the art to allow for a customizable LED light that hangs from a ceiling while at the same time providing good lighting, heat dissipation, and can be easily maintained.

SUMMARY SECTION OF THE INVENTION

Provided is a light fixture comprising: a) a body, the body having a central portion and two side portions, each of the two side portions situated on one side of the central portion, the two side portions and the central portions running parallel to each other, the central portion recessed in an upward direction in relation to the two side portions, the recess of the central portion forming a ballast room inside of the body; b) two end caps, each end cap attached to an end of the body; c) a plurality of LED (light emitting diode) boards attached to an inside of the side portions of the body; d) one or more ballasts inside of the ballast room; e) a ballast room cover for covering the ballast room; and f) two rectangular-shaped lenses, each lens covering the LED boards attached to the side portion of the body. Each lens can contact the body on one of its long sides and contact the ballast room cover on its other long side. The body can be fabricated from a single piece of metal. The body can have a vertical portion on each side of the central portion that is perpendicular to the side portions, and defines a height of the recess. The light fixture can further comprise a plurality of heat vents on the ballast room cover and the body. The light fixture can further comprise an opening on the room cover for attachment of a motion sensor. The light fixture can further comprise a motion sensor attached to the opening on the room cover or the end cap. The light fixture can further comprise upwardly extending hang members on the end cap. The light fixture can further comprise a wire cover placed inside of the body at each end of body in a transverse direction. The ballast room cover can be attached to the wire cover. The wire cover can have a portion which is elevated in relation to the two side portions, the ballast room cover attached to the elevated portion. The ballast room cover can have a side portion that covers a gap between the two side portions and the elevated wire cover portion. The ballast room cover can have a side portion that covers a gap between the two side portions of the body and the lenses. The light fixture can further comprise a lower side portion on the body configured for the lenses to rest on, the lower side portion configured to hold the lenses in a horizontal plane in conjunction with a slot on the ballast room cover. The ballast cover can have a horizontal portion with heat vents, the horizontal portion having an elevation facing the body that is less than an elevation facing away from the body. The ballast cover has two L-shaped legs configured to hold the lenses on one long side of the lens. The ballast can further comprise a lens holder on each L-shaped leg to create a slot for placement of the lens.

Provided is a light fixture comprising: a) a body; b) two end caps, each end cap attached to an end of the body; c) a plurality of LED (light emitting diode) boards attached to the side portions of the body; d) one or more ballasts inside of the ballast room; e) a ballast room cover for covering the ballast room; and f) two rectangular-shaped lenses, each lens covering the LED boards attached to the side portion of the body; wherein the lenses are maintained in the light fixture by the body on one long side of the lens and the ballast room cover on the other parallel long side of the lens.

DETAILED DESCRIPTION OF THE INVENTION

Figure 1:
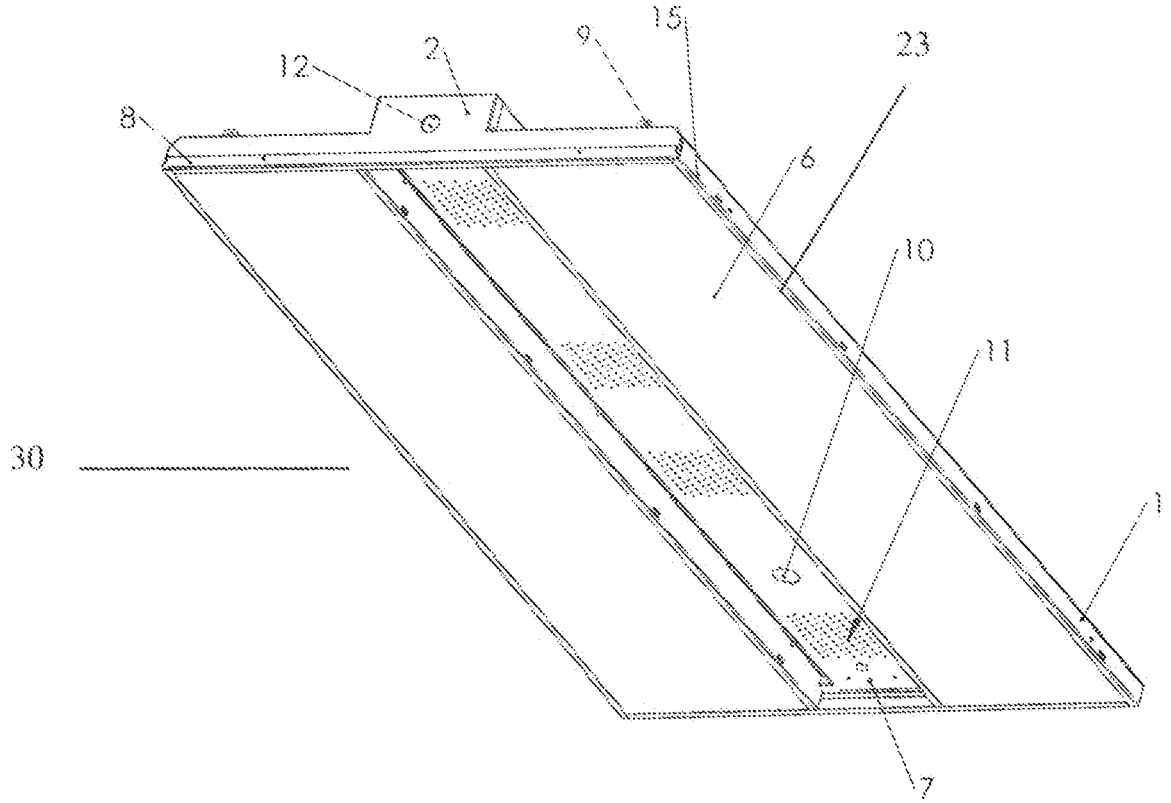
FIG. 1 illustrates a bottom perspective view of the light fixture.

Provided is a high bay light fixture 30 for attaching or suspending from a ceiling. FIG. 1 illustrates a bottom perspective view of the high bay light fixture. The light fixture can be made from a body 1 fabricated from a single piece of a material. Two lenses 6 are placed at the bottom opening of body 1, the lenses 6 running parallel to the long side of body 1. A ballast cover 7 is placed in between the two lenses 6 in a parallel fashion. The ballast cover can have an opening 10 for placement of a motion sensor and a plurality of heat vents 11. Also illustrated in this figure is end cap 2 with opening 12 for passage of wires or attachment of a motion sensor 31. Hang member 9 attached to body 1 can be used for hanging the light fixture from a ceiling.

Figure 2:
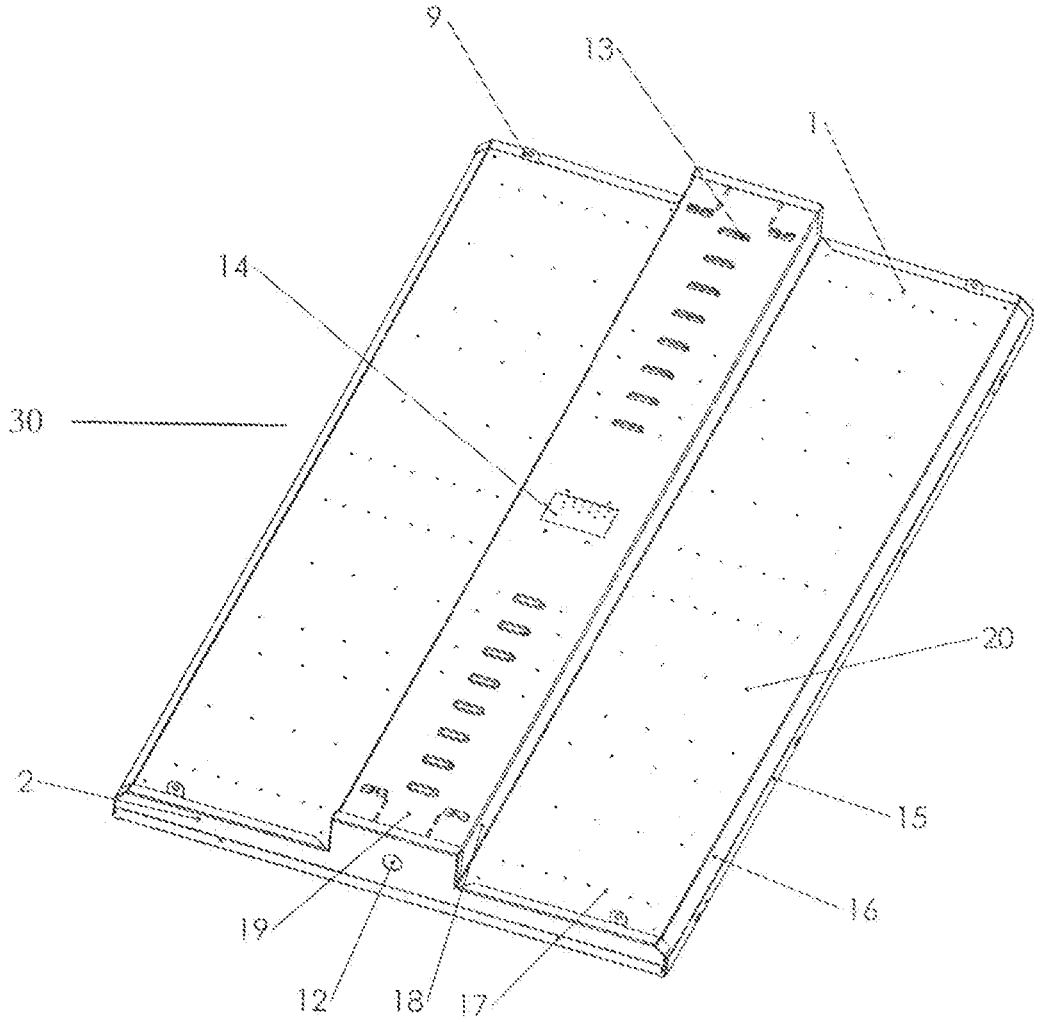
FIG. 2 illustrates a top perspective view of the light fixture.

FIG. 2 illustrates a top perspective view of light fixture 30. Body 1 is fabricated from a single piece of a material and does not require assembly. The material can be a metal, such as aluminum or steel. Body 1 has a central horizontal portion 19 that runs along the top center of body 1 in parallel fashion to the length of body 1. Central horizontal portion 19 is recessed in relation to the side horizontal portions 17 of body 1 that run parallel on each side of central horizontal portion 19. Central horizontal portion 19 is recessed towards the top relative to the side horizontal portions 17 as defined by height of vertical portion 18. The vertical portion 18 is perpendicular to both central portion 19 and side horizontal portions 17 of body 1. Side horizontal portion 17 of body 1 can be next to side slant portion of body 16, which is next to side vertical portion of body 15. All these portions (15, 16, 17) run parallel to each other. The side slant portion 16 of body 1 and side vertical portion 15 of body 1 form a wall along a length of a cavity that is formed on inside of body 1. The height of vertical portion 18 can be about 1 inch to about 2 inches, such as about 1.3 to about 1.7 inches, such as about 1.4 to 1.5 inches. Also illustrated in this view are heat vents 13 on central horizontal portion 19, end cap 2, hang member 9, junction box opening 14, and wire opening 12.

The central horizontal portion of body 19 can have a plurality of heat vents 13 configured to allow for exchange of air between ballast room 21 and outside of the light fixture. The central horizontal portion of body 19 can also have an opening 14 for attachment to a junction box. Also, illustrated in this figure is end cap 2 and wire opening 12. Wire opening 12 allows access to ballast room 21. Hang member 9 can be used to hang the fixture. Hang member 9 can extend upwardly from end cap 2. Body 1 can have a side vertical portion 15 of body 1 next to a side slant portion 16 of body 1, which slant portion runs parallel to the side horizontal portion of body 17.

Figure 3:
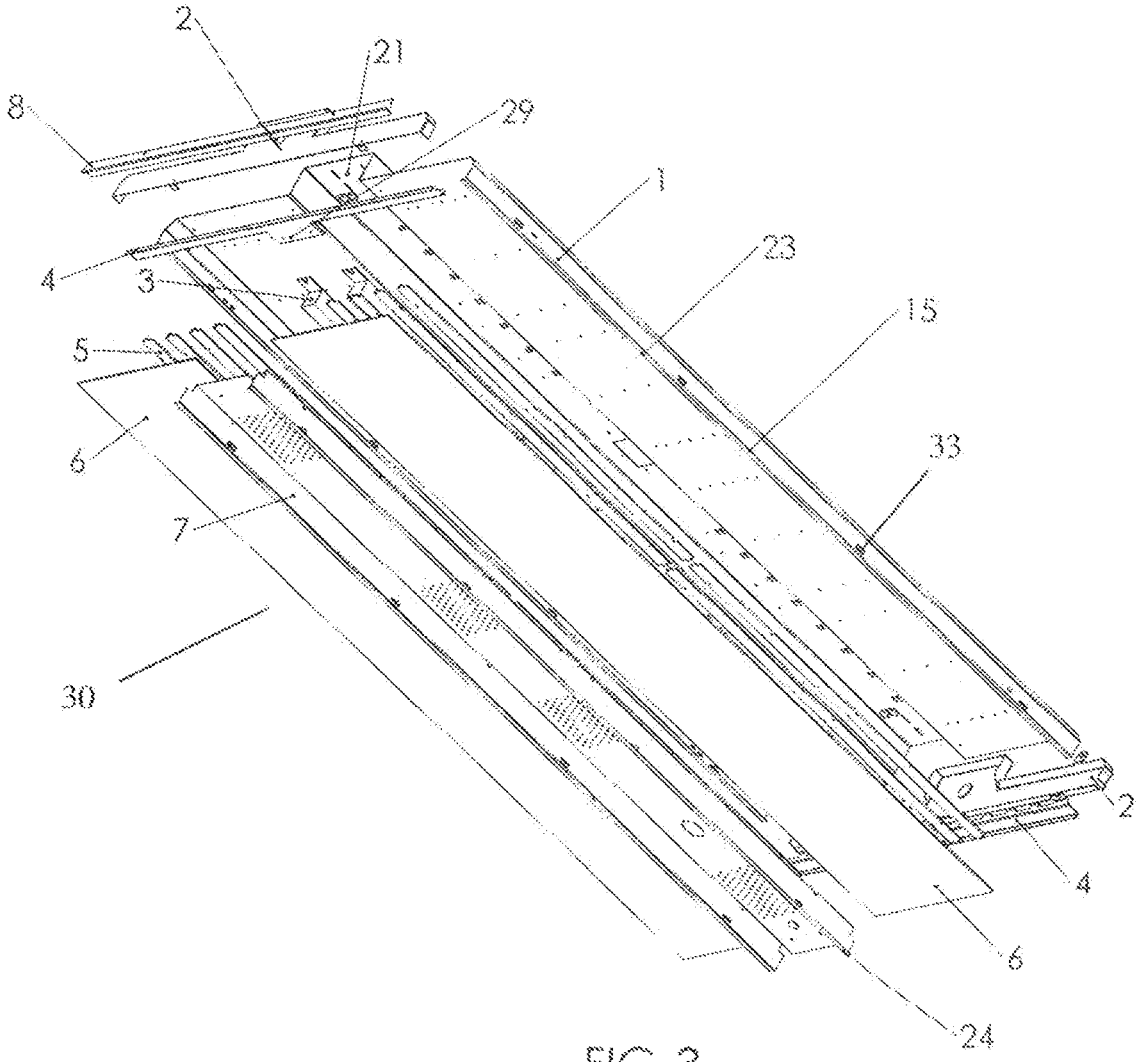
FIG. 3 illustrates a bottom perspective exploded view of the light fixture.

FIG. 3 illustrates an exploded view of light fixture 30. Body 1 can be cut from a single sheet of metal followed by pressing and/or other techniques to create body 1. Bottom side of body 1 has a cavity for placement of LED boards 5 and ballasts 3. Ballasts 3 are placed in ballast room 21, which is formed by the recess of the central horizontal portion 19 of body 1. The LED Boards 5 are attached with a fastener to the inside of the side horizontal portion of body 1. Fastener openings 20 (screw holes) can be used to fasten the LED boards 5. A wire cover 4 can be placed at each end of body 1 on the inside in a transverse direction. End cap 2 can be attached to each end of body 1 to form a barrier or a wall at ends of body 1, so that inside of body 1 would not be visible from the ends. Ballast cover 7 is placed to cover ballast room 21, which includes a plurality of ballasts 3. A pair of lenses 6 is placed on each side of ballast cover 7 in a parallel fashion. The body 1 can have lens holders 33 configured to stop the lenses 6 from collapsing on the LED Boards 5 when the light fixture moves.

Wire cover 4 has a wire cover extension 29, which is a surface in the center of wire cover 4 that is generally rectangular in shape and is used for attachment to ballast cover 7 with one or more fasteners. Wire cover 4 transverses body 1 in a substantially straight line, resting on the inside of side horizontal portions 17 of body 1. Wire, cover 4 is about 1 to about 2 inches below the central horizontal portion 19 of body 1, and is configured is such way that attachment of ballast cover 17 to wire cover 4 retains the space inside of ballast room 21. Ballast cover 17 does not intrude or only minimally intrudes into ballast room 21.

Wire cover 4 is L-shaped, elevating extension 29 in relation to inside of side horizontal portion 17 of body 1. Ballast room cover 7 by first dipping through slanting portion 28 covers this gap, and then the height of L-shaped portion 22 covers the gap between the side horizontal portion 17 and bottom horizontal portion 23 of body 1. A bottom perspective view (FIG. 1) illustrates a clean look with the two lenses 6 in parallel and in a horizontal plane, and the ballast room cover 7 recessed in relation to the lenses 6, with the side of the ballast room cover 7 covering the gap between the lenses 6 and the side horizontal portion 17 of body 1.

Figure 4:
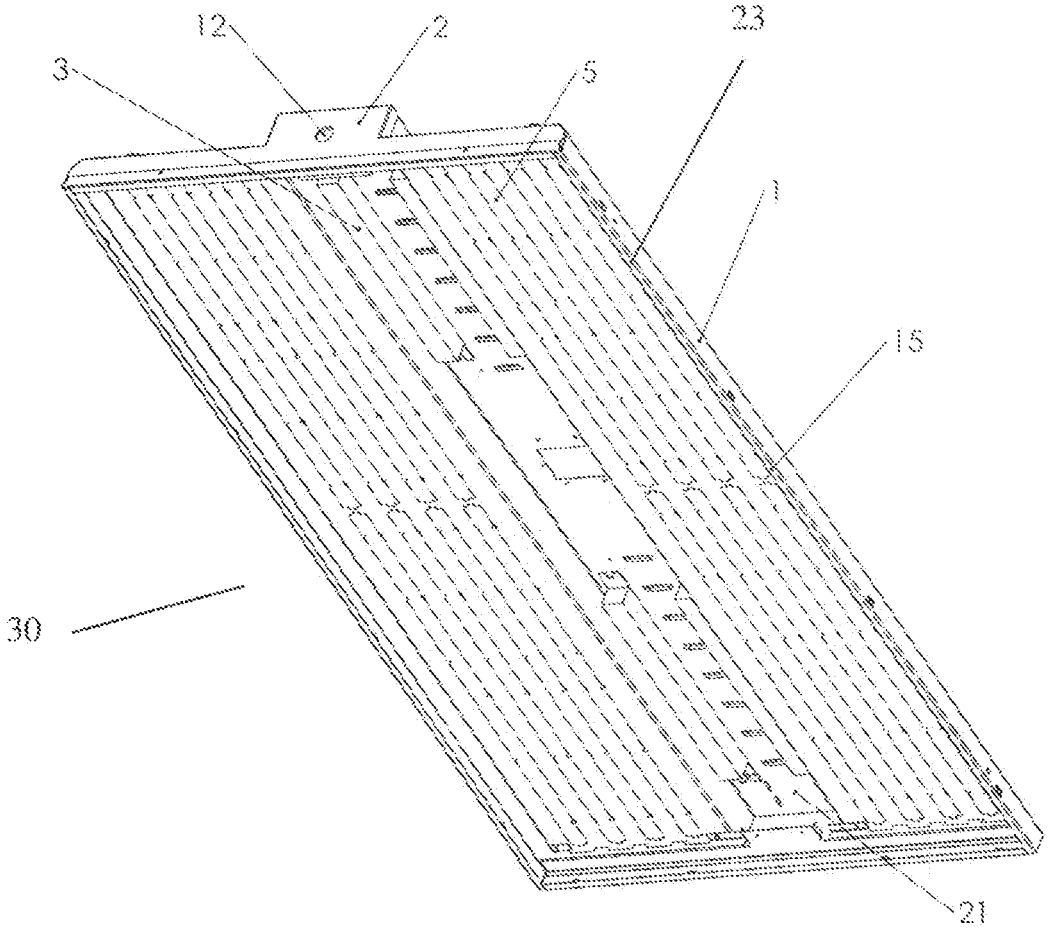
FIG. 4 illustrates a bottom perspective view of the light fixture without the lenses and the ballast room cover.
Figure 7:
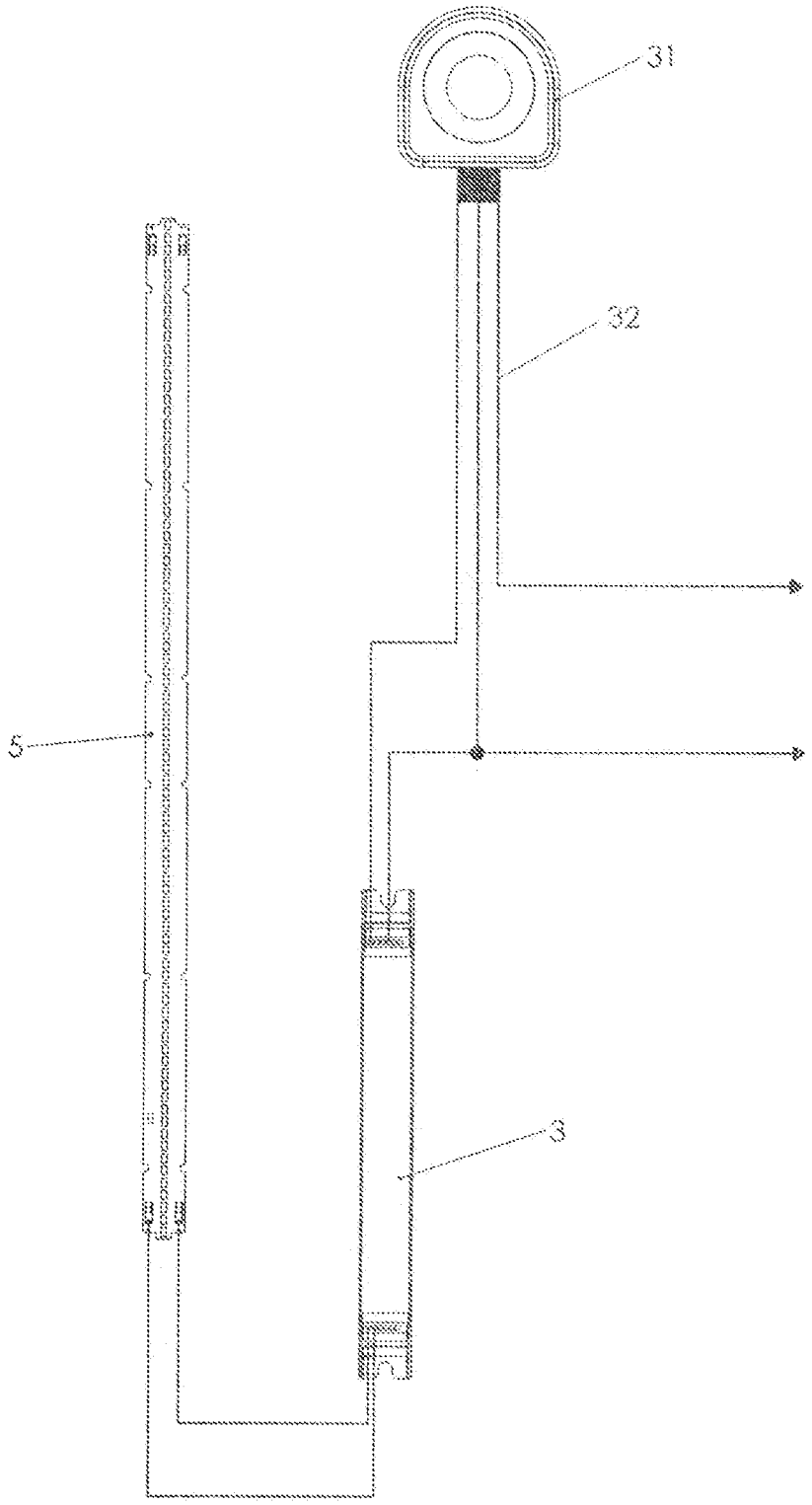
FIG. 7 illustrates wiring inside of the light fixture.

FIG. 4 illustrates a bottom perspective view of light fixture 30 with ballast cover 7 and lenses 6 removed. LED boards 5 are attached to inside of the side horizontal portion 17 of body 1. The ballasts 3 are attached to inside of the central horizontal portion 19 of body 1 and occupy ballast room 21. Wiring 32 electronically connects ballast 3 to LED Board 5 and any motion sensor 31 (illustrated in FIG. 7).

Figure 5:
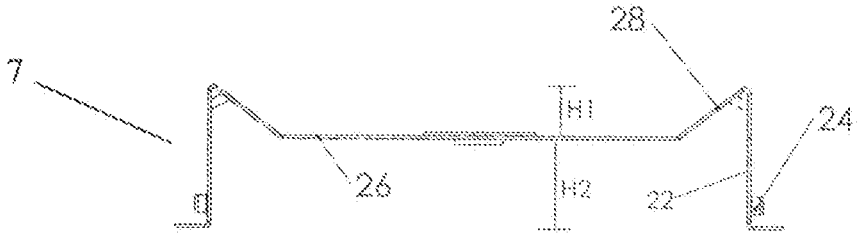
FIG. 5 is an end view of the ballast room cover.
Figure 6:
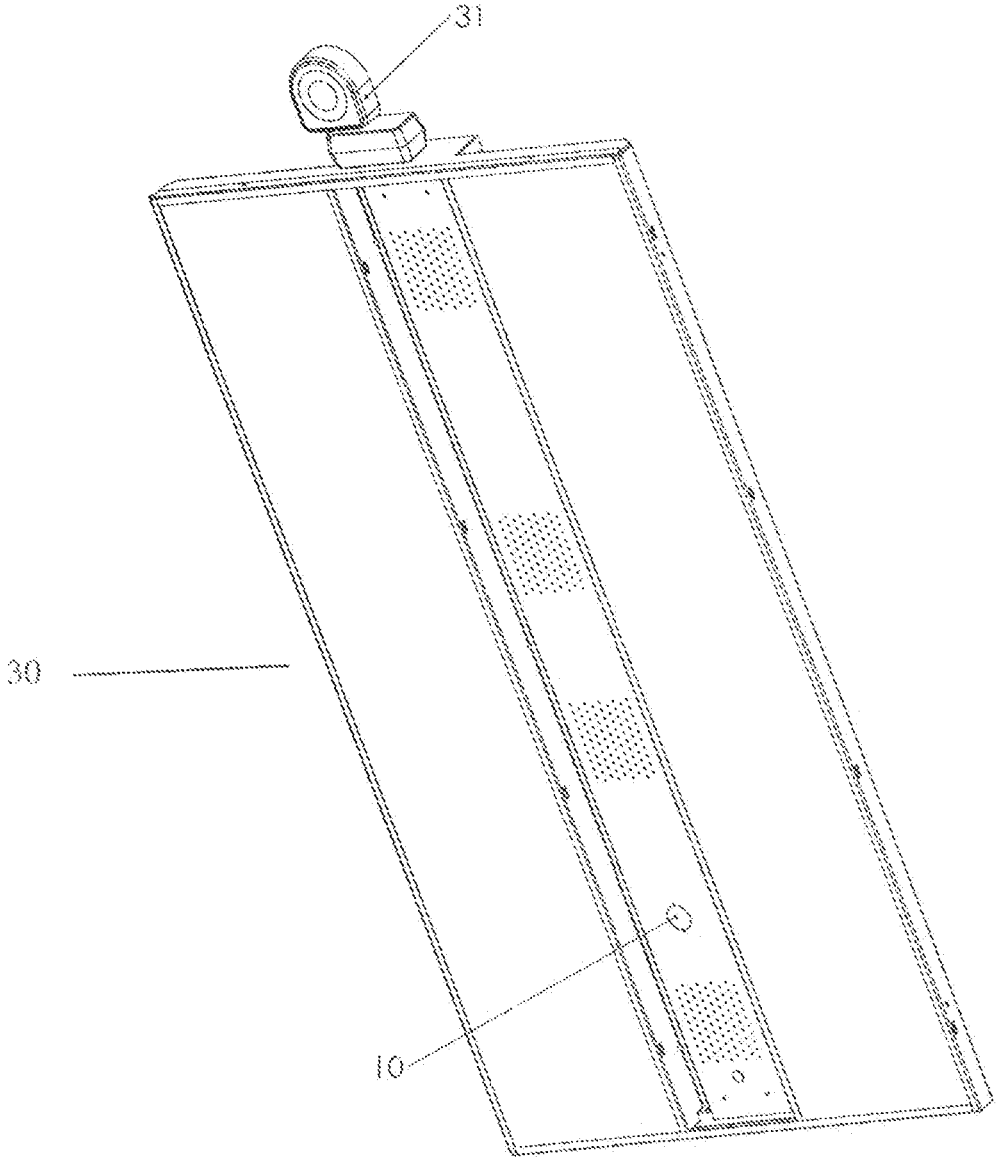
FIG. 6 illustrates a motion sensor attached to the end cap of the light fixture.

FIG. 5 illustrates the end profile of ballast cover 7. H1 represents the height of the ballast cover 7 facing towards body 1. H2, which is longer than H1, represents height of the ballast cover away from body 1. Ballast cover 7 has a horizontal portion 26, followed by downwardly slanting portions 28 that slant towards body 1, and two L shaped portions which together with lens holder 24 hold lens 6 in slot 24. The lens 6 is held on one of its long sides in slot 25, and the other long side of the lens is held in place by bottom horizontal portion 23 of body 1 which is horizontal in direction and runs along each side of body 1 and is next to and perpendicular to vertical portion 15. The lens 6 rests on bottom horizontal portion 23 at one of its ends. Lenses 6 are held in a horizontal plane. To position lenses 6 in a horizontal plane, bottom (horizontal portion) of L portion 22 of ballast cover 7 is in substantially the same horizontal plane as bottom horizontal portion 23.

To assemble light fixture 30, end caps 2 are fastened to each end of body 1 to enclose the cavity inside body 1 on all sides. Wire covers 4 are placed at each end of body 1 running in a transverse direction from one side of body 1 to other side of body 1. Ballasts 3 are placed inside ballast room 21 and are attached to the central horizontal portion 19 of body 1 with fasteners. LED Boards 5 are placed on the inside of body 1 in a parallel fashion and are fastened to the horizontal side portion 17 of body 1. The ballast cover 7 is then placed over ballast room 21, and is attached to extension 29 of wire cover 4. Each lens 6 then slides in place in between side vertical portion 15 of body 1 and slot 24 on ballast cover 7. A motion sensor 31 can be attached to opening 10 on ballast cover 7. The light fixture 30 has two different ends caps 2. One end cap 2 covers the end of the lens 6 and blocks the lens from moving. The end cap 2 illustrated in FIG. 1 is shorter, and allows access for sliding the lenses 6 into the light fixture. Lens securing member 8 is then attached to the fixture to block movement of the lenses 6.

REFERENCES

1. Body
2. End Cap
3. Ballast
4. Wire Cover
5. LED (Light Emitting Diode) Board
6. Lens
7. Ballast Cover
8. lens securing member
9. hang member
10. motion sensor opening
11. heat vents
12. wire opening
13. heat vents
14. junction box opening
15. side vertical portion of body
16. side slant portion of body
17. side horizontal portion of body
18. central vertical portion of body
19. central horizontal portion of body
20. fastener opening
21. Ballast room
22. L portion of ballast cover
23. bottom horizontal portion
24. Lens holder
25. slot for lens
26. horizontal portion of ballast cover
28. slanting portion of ballast cover
29. wire cover extension
30. Light fixture
31. motion sensor
32. wiring
33. body lens holder

What is claimed is:

1. A light fixture comprising:

a) a body fabricated from a single piece of a material, the body having a central portion and two side portions, each of the two side portions situated on one side of the central portion, the two side portions and the central portions running parallel to each other, the central portion recessed in an upward direction in relation to the two side portions, the recess of the central portion forming a ballast room inside of the body;

b) two end caps, each end cap attached to an end of the body;

c) a plurality of LED (light emitting diode) boards attached to an inside of the side portions of the body;

d) one or more ballasts inside of the ballast room;

e) a ballast room cover for covering the ballast room, the ballast cover having a horizontal portion and a leg on each side of the horizontal portion, the legs extending downward in relation to the horizontal portion; and f) two rectangular-shaped lenses, each lens covering the LED boards attached to the side portion of the body, wherein each lens contacts the body on one of its long sides and contacts the leg of the ballast room cover on the lens' other long side.

2. The light fixture of claim 1, wherein the material is metal.

3. The light fixture of claim 1, wherein the body has a vertical portion on each side of the central portion that is perpendicular to the side portions, and defines a height of the recess.

4. The light fixture of claim 1, further comprising a plurality of heat vents on the ballast room cover and the body.

5. The light fixture of claim 1, further comprising an opening on the room cover for attachment of a motion sensor.

6. The light fixture of claim 1, further comprising a motion sensor attached to the opening on the room cover or the end cap.

7. The light fixture of claim 1, further comprising upwardly extending hang members on the end cap.

8. The light fixture of claim 1, further comprising a wire cover placed inside of the body at each end of body in a transverse direction.

9. The light fixture of claim 8, wherein the ballast room cover is attached to the wire cover.

10. The light fixture of claim 9, wherein the wire cover has a portion which is elevated in relation to the two side portions, the ballast room cover attached to the elevated portion.

11. The light fixture of claim 10, wherein the leg covers a gap between the two side portions and the elevated wire cover portion.

12. The light fixture of claim 9, wherein the leg covers a gap between the two side portions of the body and the lenses.

13. The light fixture of claim 1, further comprising a lower side portion on the body configured for the lenses to rest on, the lower side portion configured to hold the lenses in a horizontal plane in conjunction with a slot on the ballast room cover.

14. The light fixture of claim 1, wherein the horizontal portion has heat vents, the horizontal portion having an elevation facing the body that is less than an elevation facing away from the body.

15. The light fixture of claim 1, wherein the ballast cover has two L-shaped legs configured to hold the lenses on one long side of the lens.

16. The light fixture of claim 15, wherein the ballast cover further comprises a lens holder on each L-shaped leg to create a slot for placement of the lens.

* * * * *